US010337252B2

(12) United States Patent
Greenwood et al.

(10) Patent No.: US 10,337,252 B2
(45) Date of Patent: Jul. 2, 2019

(54) APPARATUS AND METHOD OF ALLEVIATING SPIRALING IN BOREHOLES

(71) Applicant: Halliburton Energy Services, Inc., Houston, TX (US)

(72) Inventors: Jeremy Alexander Greenwood, Houston, TX (US); Christopher Neil Marland, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/563,736

(22) PCT Filed: May 8, 2015

(86) PCT No.: PCT/US2015/029923
§ 371 (c)(1),
(2) Date: Oct. 2, 2017

(87) PCT Pub. No.: WO2016/182546
PCT Pub. Date: Nov. 17, 2016

(65) Prior Publication Data

US 2018/0094491 A1 Apr. 5, 2018

(51) Int. Cl.
*E21B 10/30* (2006.01)
*E21B 23/04* (2006.01)
(Continued)

(52) U.S. Cl.
CPC ..... *E21B 10/30* (2013.01); *E21B 10/28* (2013.01); *E21B 17/076* (2013.01); *E21B 23/04* (2013.01); *E21B 44/02* (2013.01)

(58) Field of Classification Search
CPC ..... E21B 10/30; E21B 23/04; E21B 10/28; E21B 17/076; E21B 44/02
See application file for complete search history.

(56) References Cited

U.S. PATENT DOCUMENTS 4,281,726 A 8/1981 Garrett
4,544,041 A * 10/1985 Rinaldi ..... E21B 7/208 175/104
(Continued)

FOREIGN PATENT DOCUMENTS

CN 102140893 A 8/2011
EP 2404031 B1 5/2017
(Continued)

OTHER PUBLICATIONS

International Preliminary Report on Patentability issued on related PCT Application No. PCT/US2015/029923, dated Nov. 23, 2017, 12 pages.
(Continued)

*Primary Examiner* — Giovanna C Wright
*Assistant Examiner* — Manuel C Portocarrero
(74) *Attorney, Agent, or Firm* — Alan Bryson; Baker Botts L.L.P.

(57) ABSTRACT

An apparatus and method for alleviating spiraling in boreholes is disclosed. The apparatus includes a sub, which adjusts the length of the bottom-hole assembly in response to tension/compression, flexural bending and/or torque measurements made above and below the reamer so that the drill bit and the reamer cut at the same depth rate. The sub is connected between the drill bit and the reamer. The apparatus further includes measurement devices disposed on the bottom-hole assembly above and below the reamer, which are capable of measuring the tension/compression, flexural bending and torque in the bottom-hole assembly. The method includes use of a data processor, which determines which operational output signals to supply to the sub in order to adjust its length and thereby accomplish the desired drilling rates.

20 Claims, 7 Drawing Sheets

(51) Int. Cl.

| | |
|---|---|
| ***E21B 10/28*** | (2006.01) |
| ***E21B 17/07*** | (2006.01) |
| ***E21B 44/02*** | (2006.01) |

(56) References Cited

U.S. PATENT DOCUMENTS

| | | | | |
|---|---|---|---|---|
| 4,901,806 | A | 2/1990 | Forrest | |
| 5,476,148 | A | 12/1995 | LaBonte | |
| 7,044,240 | B2 | 5/2006 | McNeilly | |
| 7,316,277 | B2 | 1/2008 | Jeffryes | |
| 7,654,344 | B2 | 2/2010 | Haughom et al. | |
| 8,146,680 | B2 | 4/2012 | Mock et al. | |
| 8,327,954 | B2 | 12/2012 | Desai | |
| 8,584,776 | B2 | 11/2013 | Radford et al. | |
| 8,662,202 | B2 | 3/2014 | Lee | |
| 2005/0211470 | A1 | 9/2005 | Jeffryes | |
| 2005/0257629 | A1* | 11/2005 | Gilbert | E21B 49/10 73/863.84 |
| 2012/0255775 | A1 | 10/2012 | Stacey, II et al. | |
| 2013/0037326 | A1 | 2/2013 | Essel et al. | |
| 2013/0220701 | A1 | 8/2013 | Crowley et al. | |
| 2014/0096972 | A1* | 4/2014 | Leiper | E21B 37/00 166/311 |
| 2014/0182934 | A1 | 7/2014 | Samuel | |

FOREIGN PATENT DOCUMENTS

| | | | |
|---|---|---|---|
| WO | 2010-101473 | A1 | 9/2010 |
| WO | 2014-105034 | A1 | 7/2014 |
| WO | 2015-065410 | A1 | 5/2015 |

OTHER PUBLICATIONS

Fazaelizadeh, Mohammad. Real Time Torque and Drag Analysis during Directional Drilling. Diss. University of Calgary, 2013.

Denney, Dennis, "Intelligent Intervention" Technology Applications, Journal of Petroleum Technology, Oct. 2012, p. 22.

International Search Report and Written Opinion issued in related PCT Application No. PCT/US2015/029923 dated Jan. 26, 2016, 15 pages.

* cited by examiner

APPARATUS AND METHOD OF ALLEVIATING SPIRALING IN BOREHOLES

CROSS-REFERENCE TO RELATED APPLICATION

The present application is a U.S. National Stage Application of International Application No. PCT/US2015/029923 filed May 8, 2015, which is incorporated herein by reference in its entirety for all purposes.

TECHNICAL FIELD

The present disclosure relates generally to bottom hole assemblies (BHAs) used in drilling wellbores in subterranean formations, and more particularly, to an apparatus and method of alleviating spiraling in boreholes, which can occur in some applications with BHAs having a hole enlargement device such as an underreamer.

BACKGROUND

Hydrocarbons, such as oil and gas, are commonly obtained from subterranean formations that may be located onshore or offshore. The development of subterranean operations and the processes involved in removing hydrocarbons from a subterranean formation typically include a number of different steps such as, for example, drilling a wellbore from a surface location to a desired target in the reservoir, treating the wellbore to optimize production of hydrocarbons, and performing the necessary steps to produce and process the hydrocarbons from the subterranean formation.

The drilling part of completing a well can present many challenges, especially in those formations, which are difficult to drill, such as highly interbedded formation, hard formations or complicated geological structures. Those formations, which require access through complex angles such as is required with directional drilling can also present many challenges as can those formations having many differing structures throughout their depth.

In some drilling applications, it is necessary to enlarge the wellbore to a greater diameter than the drill bit and/or the pass-through diameter of the previous casing string. This can be required for different reasons, the main one being to reduce the circulating pressure of drilling fluid or cement in the wellbore.

Such an operation is commonly known as reaming. This is often accomplished using a device known as a reamer or underreamer. A reamer is included as part of the BHA and attached above the drill bit assembly. The reamer is a secondary drilling apparatus having cutters, which remain retracted within the BHA until it is desired to drill the enlarged hole above the drill bit assembly. There are many mechanisms used to expand and retract the reamer from the BHA, which are well known within the art.

In some applications, especially those involving formations having inter-beds of different strength or structures that intersect the wellbore at different angles, which vary from region to region, the reamer can cut at a different speed than the drill bit, cutting their respective formations at differing depths per unit of time, faster or slower depending on the rock strength. This change in loading between the two cutting structures causes different levels of compression and tension within the BHA above the bit and below the reamer and also above the reamer. This variation in load can cause the borehole to become spiraled as the orientation of the cutting faces is altered as the compression or tension bends the drill collars between the two cutting structures by varying amounts. Different amounts of wear are also induced on the cutting structures by failing to balance the load causing a greater difference in the rates at which the reamer and bit will drill.

If the spiraling is severe enough it is possible for the BHA to become lodged in the wellbore. Spiraling builds up torque on the stabilizers or other down-hole equipment in contact with the formation. This can adversely affect the drilling operation by reducing the rate of penetration, causing premature wear to the cutting structures, increasing the difficulty of moving cuttings out of the wellbore as it becomes spiraled and potentially causing the BHA to become stuck either through the mechanical creation of ledges or excessive cuttings build up. Thus, there remains a need in the art for minimizing spiraling of the borehole in an effort to prevent the BHA from becoming stuck in the borehole during back reaming and to improve overall drilling performance.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
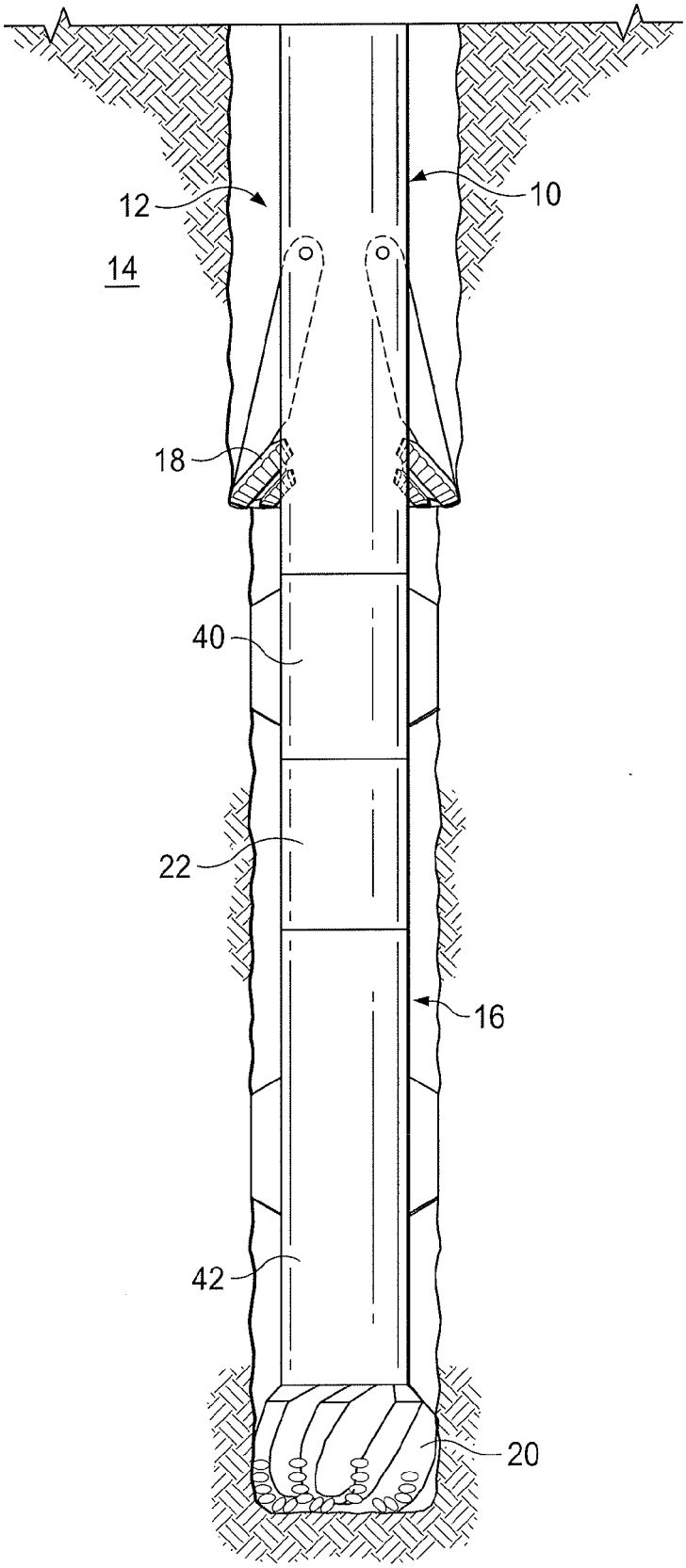
FIG. 1 is a schematic diagram illustrating a bottom-hole assembly in accordance with the present disclosure installed in a wellbore illustrating a sub capable of altering the length of the bottom-hole assembly in a compressed position.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

To maintain the correct load on the cutting structures and prevent spiraling a sub can be installed on the drill string in accordance with the present disclosure. The sub may not only maintain a certain level of force on the cutting tool but also relieves some of the axial length as the drill string is torqued upward. The sub may be positioned on the drill string between the two cutting structures, above the reamer or in both positions. The sub relieves a portion of the axial contraction or increases the amount of axial contraction to balance the load on the cutting structures while still allowing for torsional force to be translated through the string and down to the BHA and bit.

The cutting structure when drilling and reaming has a force applied to the cutters by reducing the tension in the drill string above the cutting structures to apply load. The tension required at the top of the drill string is the required weight minus the surface load. Which is the sum of the buoyant weight of the drill string from the top of the drill string to the cutting structure, plus any drag exerted on the drill pipe from contact with the wellbore wall as the string is rotated and moved axially, plus the required force at the cutting structure to drill the rock, plus the buoyant weight of the BHA below the cutting structure, plus any drag of the BHA below the cutting structure from contact with the wellbore wall as the string is rotated and moved axially.

The factors that cause variation in the force being applied to the cutting structure assuming a constant tension is maintained at the surface are as follows:

1) The speed at which one cutting structure drills relative to the other. If the drill bit penetrates the rock faster, the load on the reamer is increased as less of the BHA is in compression below the reamer and more force is applied to the reamer. If the drill bit penetrates slower, the load on the reamer is decreased as there is more of the BHA in compression below the reamer lessening the force applied.

2) The shortening of the drill string above the cutting structure, increasing the force, caused by the torque applied to turn the cutting structure causing elastic deformation of the drill string in a torsional mode. The force applied to the cutting structures and the strength of the rock that is being cut will control the amount of torque required to cut the formation and hence the change in drill string length through torsional deformation.

3) The variation in drag of the BHA below the cutting structure, decreasing the force, as the BHA is moved through the enlarged hole below the cutting structure which will be a factor of the size of the hole enlargement and the BHA length and the hole angle which will determine how much of the BHA is in contact with the wellbore wall. Variations in the drag are also influenced by the differential pressure inside and outside the drill string caused by changes in the mud flow rate changing the stiffness of the drill string.

To establish the force being applied to the bit cutting structure, a device that measures axial and torsional loads is positioned between the bit and reamer cutting structures within the BHA. To establish the force being applied to the reamer cutting structures a second device that measures axial and torsional loads is positioned above the reamer cutting structures. Both the actual loads on the bit and reamer cutting structures and the differential loads across the reamer cutting structure are measured. A third device, such as a sub, is placed above the drill bit that is able to shorten or elongate a defined amount to reduce or increase the force applied to the cutting structures of the reamer by compensating for the amount of shortening or elongation of the BHA through variation in tension and compression below the reamer. The distance that the sub elongates or shortens is governed by the information on the actual loads derived from the devices measuring the force being applied. With the objective of maintaining a constant torque at the cutting structure, the value of the constant torque will be established by a calculation in the tool that examines the average torque being applied over a fixed window to allow for changes in torque demand caused by variations in the formation strength.

Figure 5:
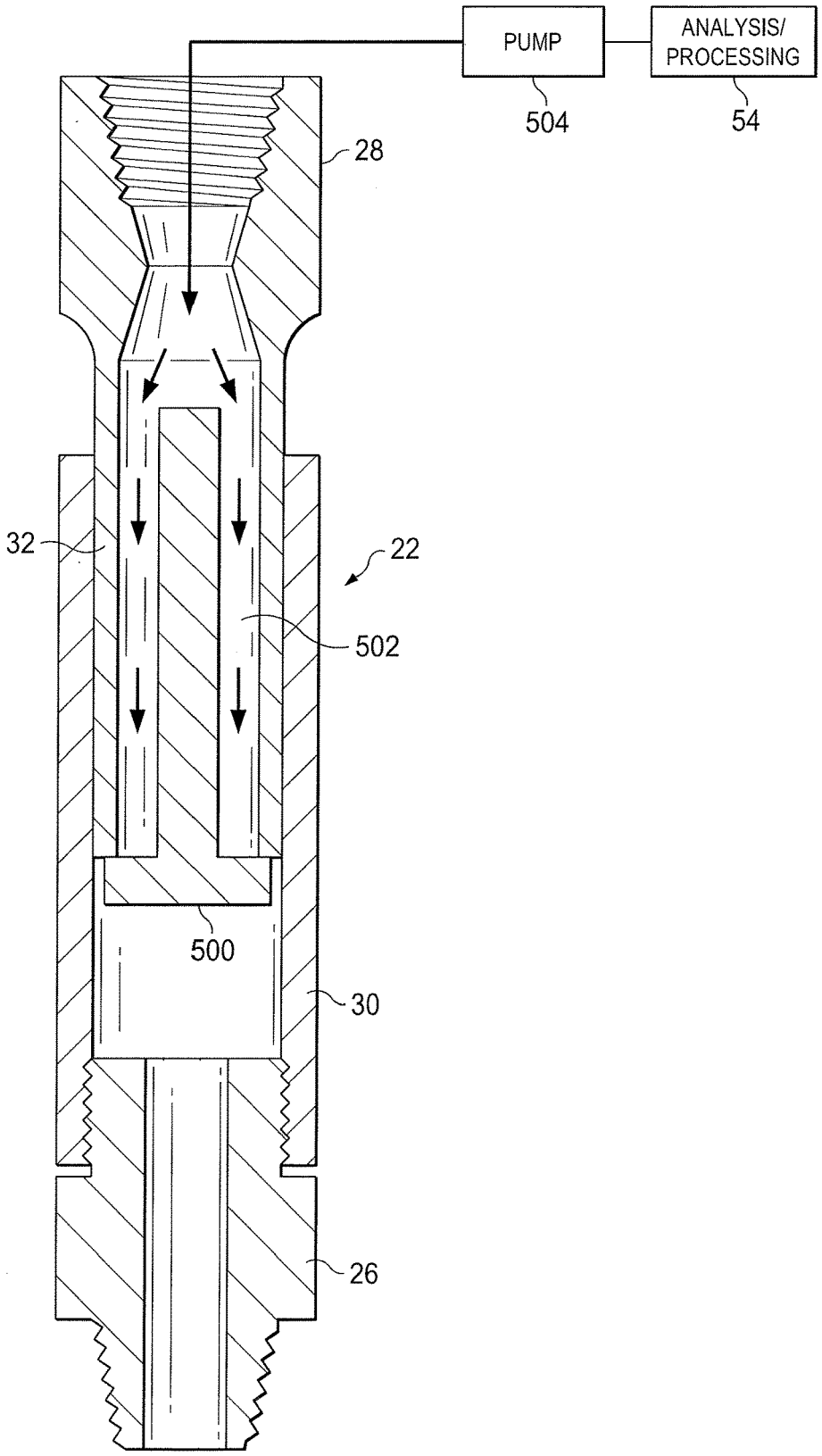
FIG. 5 is a schematic diagram of an alternate embodiment of the sub shown in FIG. 1 whereby the sub is expanded or contracted by action of a hydraulically-activated ram.

The device for controlling the amount of elongation or shortening of the sub within the drill string can take the form of a number of different embodiments, including but not limited to:

1) A hydraulic ram where the amount of extension can be adjusted by pumping fluid in and out of a chamber, which actuates the ram. This embodiment is shown in FIG. 5.

Figure 6:
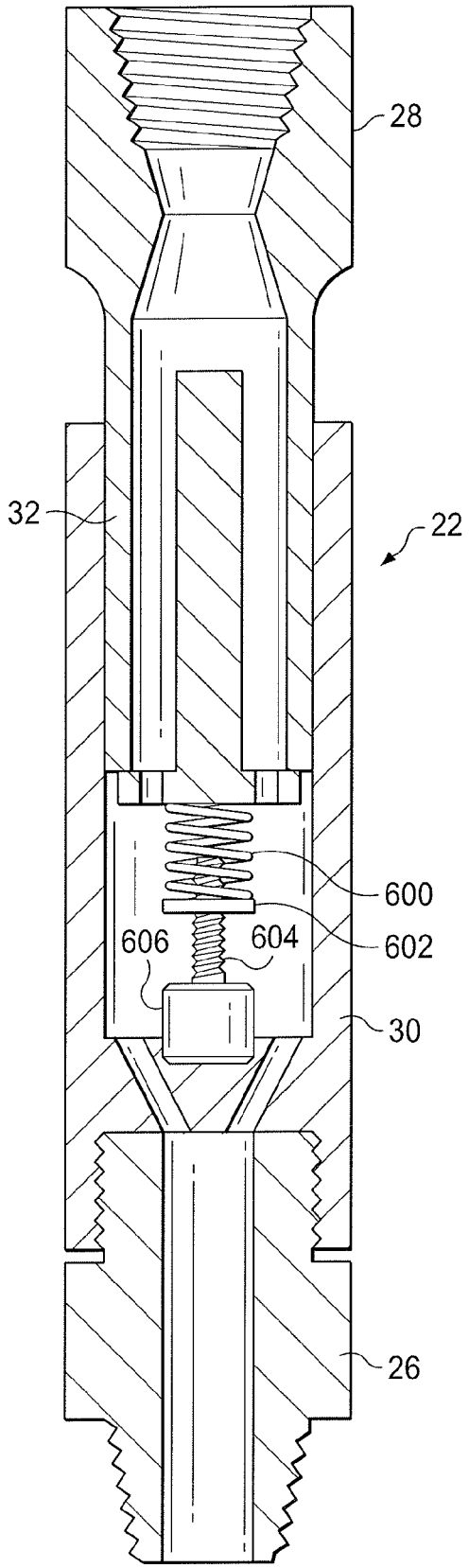
FIG. 6 is a schematic diagram of an alternate embodiment of the sub shown in FIGS. 1 and 2 whereby the sub is expanded or contracted by action of a grub screw compressed plate and spring.

2) A spring with a retaining plate that is moved on a grub screw. This embodiment is shown in FIG. 6. The spring passes through the retaining plate and as the plate is turned it varies the length of the spring that can elastically deform below the plate by compressing the part of the string above the retaining plate. The grub screw may be controlled by a motor, which can be controlled by the tool electronics. Power to the motor may be supplied by a hydraulic pump, which in turn is powered by circulation of the drilling mud.

Figure 7:
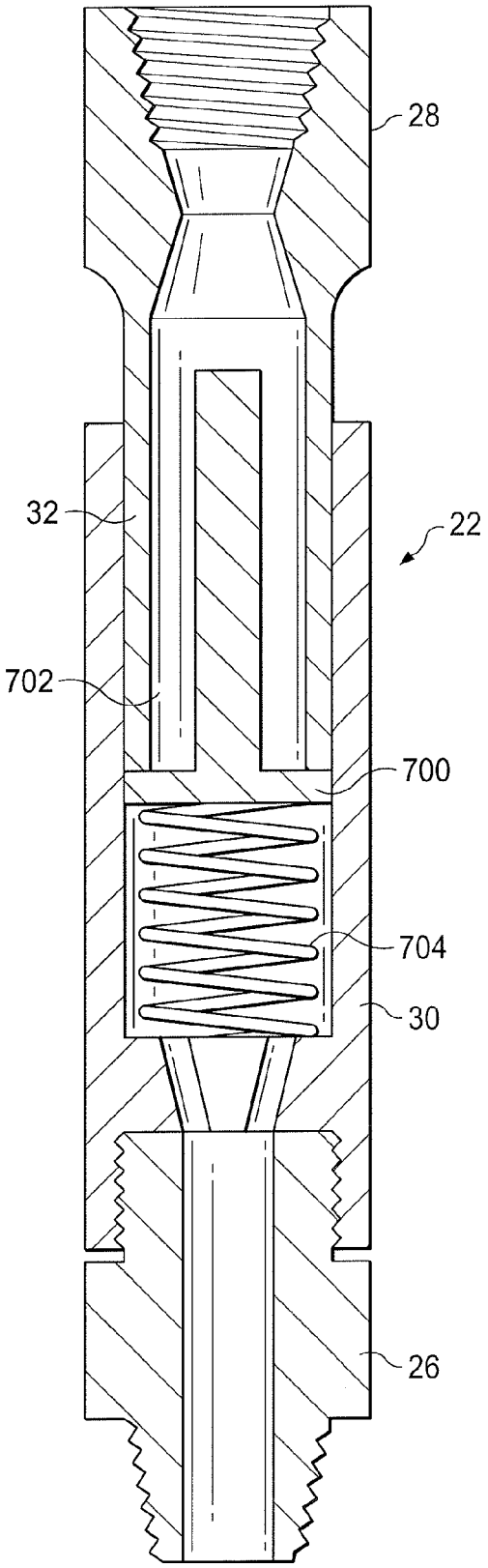
FIG. 7 is a schematic diagram of an alternate embodiment of the sub shown in FIGS. 1 and 2 whereby the sub is expanded or contracted by action of a plunger which moves in response to a rheologically-activated fluid which changes its viscosity in the presence of a changing magnetic field.

3) A cylinder with a plunger. This embodiment is shown in FIG. 7. The difference between this embodiment and the first embodiment is that the cylinder may be filled with a magneto-rheological fluid whose viscosity can be varied in response to changes in a magnetic field. Changes in the viscosity of the fluid in turn cause the plunger to move, as opposed to increases in the fluid pressure caused by a pumping action, which in turn translates into a lengthening or shortening of the length of the BHA.

The device can be controlled in several ways in order to elongate or shorten the sub to ensure the balance between tension and compression of the two cutting structures is managed in such a way to avoid borehole spiraling. The device can be programmed to ensure a fixed load balance is maintained on each of the cutting structures when reaming is activated. This will ensure that when the reamer is activated and a set weight is applied to the bottom-hole assembly the sub controls the elongation of the drill string to ensure that the slacked off weight is distributed evenly across the cutting structures of the drill bit and reamer.

The sub can be designed to also be controlled through communication commands from surface computers. This downlink command and control is well known in the art. Control of the sub in this fashion can be done to ensure the tension and compression of the bottom-hole assembly is balanced to ensure torque and cutting structure depth of cut are optimal for the geological formation being drilled. As previously described different formations may have differing rock strength, therefore the load applied to the cutting structure needs to be varied to optimize the relative penetration rate of each structure. As a new formation is entered a different weight distribution can be sent through downlink command to the sub in order to balance the loads as required.

The sub can be designed to automatically control the load distribution for tension, compression and torque on each cutting structure. In a similar manner to that previously described, the sub can manage the load distribution based on known geological conditions. In this example the sub would be programmed at the surface with the required load distribution for each geological formation and for each transition between formations if applicable. As the drilling assembly drills the borehole the load is managed according to this pre-programmed set of conditions. Regular updates via downlink or other command from surface will update the sub to the current depth and therefore what loads to apply. The pre-programmed models can be updated to account for geological uncertainty in formation depth and to account for changes in geological conditions that may require different load balancing.

Further details of the present disclosure will now be provided with reference to the figures. A drill string having a bottom-hole assembly in accordance the present invention is shown generally in FIG. 1 by reference numeral 10. The drill string 10 is disposed in a wellbore 12 formed in a subterranean formation 14. As those of ordinary skill in the art will appreciate, the subterranean formation 14 may located below the subsea floor or be located on-shore. The drill string 10 includes a bottom-hole assembly 16. Bottom-hole assembly 16 includes a reamer 18 and a drill bit 20. The drill bit 20 is the primary cutting means for forming the wellbore 12 in the subterranean formation 14. The reamer 18 widens the wellbore just above the section of the wellbore being drilled by the drill bit 20.

Figure 2:
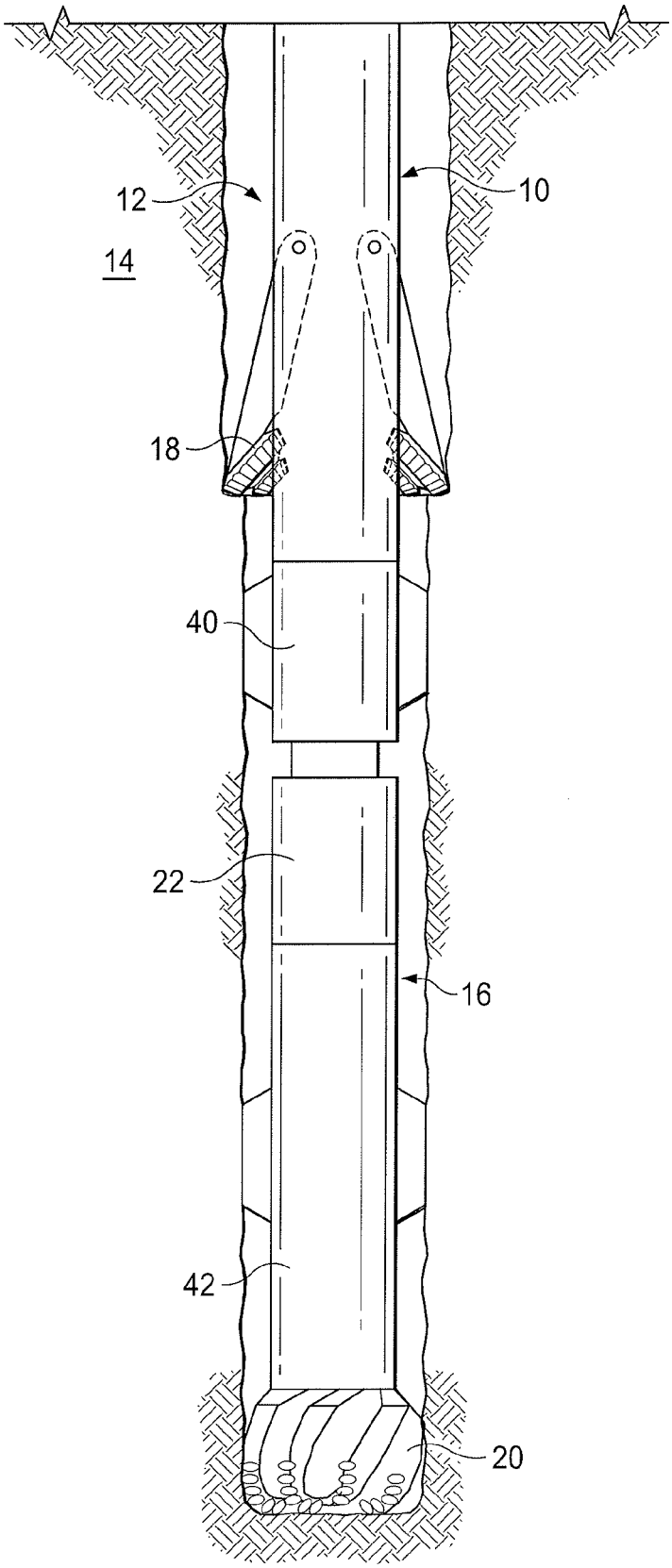
FIG. 2 is a schematic diagram of the bottom-hole assembly shown in FIG. 1 illustrating the sub in an expanded position.
Figure 3:
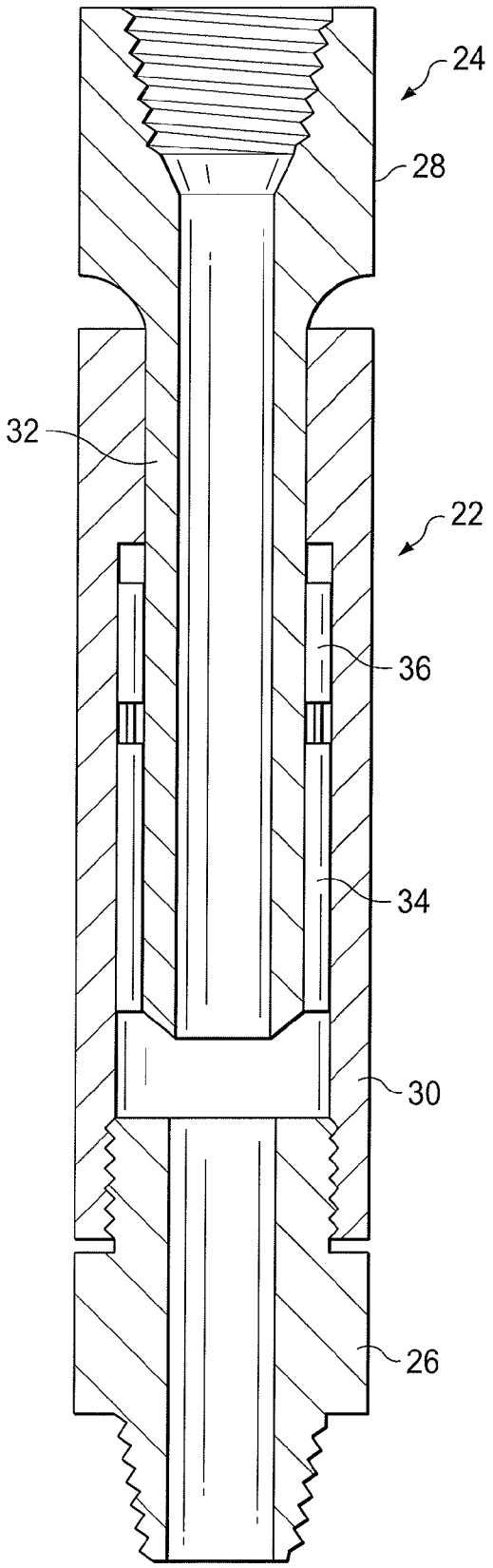
FIG. 3 is a schematic diagram of one embodiment of the sub shown in FIGS. 1 and 2.

The bottom-hole assembly 16 includes a sub 22, which is located between the reamer 18 and the drill bit 20. The sub 22 is capable of extending from a contracted position (shown in FIG. 1) to an expanded position (shown in FIG. 2). The sub 22 is shown in FIG. 3 in more detail. It is formed into two main sections, an upper sub 24 and a lower sub 26. The upper sub 24 connects via a threaded connection to a stablizer 40 (shown in FIGS. 1 and 2), which in turn is connected to the reamer 18. The lower sub 26, connects via a threaded connection to a stabilizer 42 (shown in FIGS. 1 and 2), which in turn is connected to the drill bit 20. The upper sub 24 is defined by an upper section 28 and a lower section 30. The lower section 30 of the upper sub 24 is capable of sliding relative to the upper section 28 of the upper sub 26 in a telescoping fashion. It is the telescoping movement of the upper section 28 relative to the lower section 30 of the upper sub 24 which enables the sub 22 to move from a contracted or closed position (as shown in FIG. 1) to an extended or open position (as shown in FIG. 2).

The upper section 28 of the upper sub 24 has a main body 32, which is generally cylindrical shaped and disposed within the lower section 30. The main body 32 slides relative to the lower section 30 by operation of an actuation mechanism 34. As those of ordinary skill in the art will appreciate, there are a number of suitable actuation mechanisms 34 that can be employed in the sub 22. Non-limiting examples of such mechanisms include a hydraulically-activated ram which moves laterally in response to differential fluid pressures created by a pump, a fluid-activated plunger which moves in response to changes in the viscosity of the fluid, which in turn is caused by changes in a magnetic field, a spring with a retaining plate that is moved on a motor-driven grub screw, as well as other known devices for altering the length of an object.

The sub 22 further includes an electronics module 36, which in one embodiment is disposed between the main body 32 and the lower section 30 of the upper sub 24 and which communicates with, and activates, the actuation mechanism 28. In one embodiment, the electronics module 36 may have the processing capability built into it, thereby making the sub 22 a smart sub. In another embodiment, the processing capability is at the surface (as shown in FIG. 4), such that the electronics module simply passes commands from the surface to the actuation mechanism 28 via telemetry, a wired-connection, acoustics, fiber optics or other known communication means.

Figure 4:
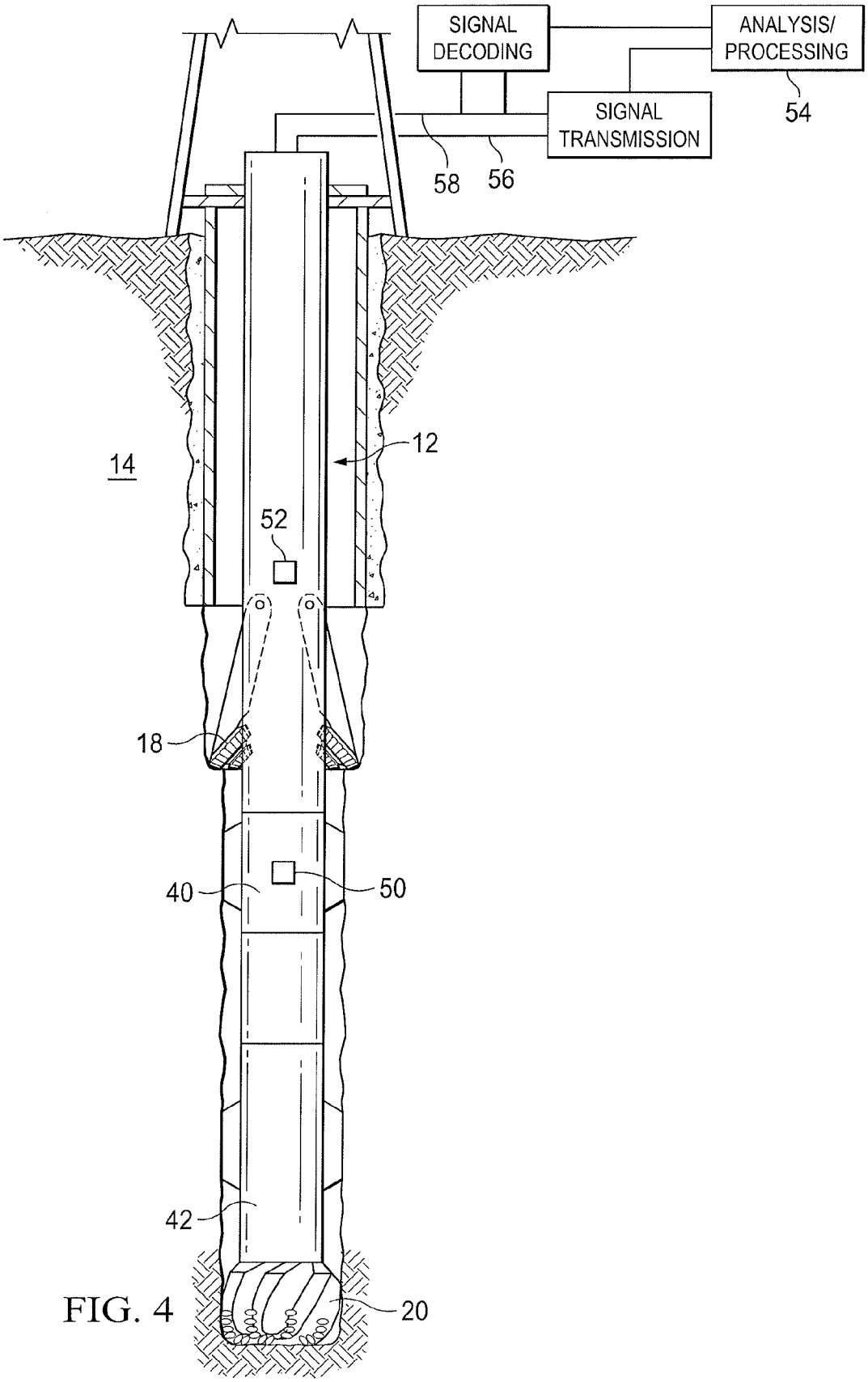
FIG. 4 is a schematic diagram illustrating the control system which communicates with the sub shown in FIGS. 1 and 2.

Turning to FIG. 4, the electronics system which determines the conditions under which the sub 22 needs to be activated will now be described. The electronics system includes a first measurement device 50, which is capable of measuring axial and torsional loads in the BHA below the reamer 18. The first measurement device 50 is placed on the bottom-hole assembly 16 between the reamer 18 and the drill bit 20. The electronics system also includes a second measurement device 52, which is placed on the drill pipe 10 just above the reamer 18. The second measurement device 52 is capable of measuring the axial and torsional loads on the drill string 10 proximate the reamer 18. Both the actual loads on the bit 20 and reamer 18 cutting structures and the differential loads across the reamer cutting structure are measured. The first and second measurement devices 50 and 52 may be transducers or other known measurement devices. The first and second measurement devices 50 and 52 communicate with a signal processor, which may be located in the electronics module 36 within the sub 22 (shown in FIG. 3) or alternatively in a stand-alone device 54 at the surface, as shown in FIG. 4. The signals from the measurement devices 50 and 52 may be transmitted via wires 56 and 58 or via wireless transmission, such as telemetry, acoustic transmission or fiber optics. The axial and load signals are analyzed in the processor 54 to determine the distance that the sub 22 needs to elongate or shorten. As noted above, the objective is to maintain a constant torque at the cutting structures 18, 20. The value of the constant torque will be established by a calculation in the tool that examines the average torque being applied over a fixed window to allow for changes in torque demand caused by variations in the formation strength. The processor 54 makes this determination and then sends a decoded signal to the electronics module 36, which in turn activates the actuation mechanism 34, as may be necessary.

Turning to FIGS. 5-7, the various described mechanisms for expanding and contracting the sub are shown. FIG. 5 shows the embodiment of a hydraulically-activated ram 500 which moves the main body 32 of the sub 22 relative to the lower section 30. The ram 500 is attached to the main body 32. The ram 500 is disposed in a chamber 502 which is filled on one side with a hydraulically-activated fluid. The hydraulically-activated fluid is supplied to the chamber 502 by a pump 504, which is shown in FIG. 5 at the surface, but which may be disposed in the sub 22 or elsewhere down hole. The pump 504 is controlled by processor 54 based on the calculations processor 54 has made to determine how much the sub 22 should be expanded or contracted to achieve the desired operational parameters for the reamer 18 and drill bit 20.

FIG. 6 illustrates an alternate embodiment of the actuation mechanism 34. This figure illustrates an embodiment whereby actuation mechanism includes a spring 600 attached to retaining plate 602, which in turn is moved on a grub screw 604. The spring 600 passes through the retaining plate 602 and as the plate is turned it varies the length of the spring that can elastically deform below the plate by compressing the part of the string above the retaining plate. The spring 600 is attached to the main body 32, so that upon activation it can slide relative to the lower section 30. The grub screw 604 may be controlled by a motor 606, which can be controlled by the tool electronics, which as noted above can either be at the surface or in the sub 22. Power to the motor 606 may be supplied by a hydraulic pump (not shown), which in turn is powered by circulation of the drilling mud.

FIG. 7 illustrates another alternate embodiment of the actuation mechanism 34. In this embodiment, the sub 22 is expanded and contracted by action of a plunger 700 which under the influence of a rheologically-activated fluid, which is disposed within a chamber 702. The fluid changes viscosity in response to a changing magnetic field, which may be generated by an inductor 704 controlled by tool electronics, which as noted above can either by at the surface or in the sub 22. The plunger 700 is attached to the main body 32 of the sub 22, so that upon activation it can slide relative to the lower section 30 thereby expanding or contracting the sub 22 and in turn varying its length.

Although the present disclosure and its advantages have been described in detail, it should be understood that various changes, substitutions and alterations can be made herein without departing from the spirit and scope of the disclosure as defined by the following claims.

What is claimed is:

1. A bottom-hole assembly, comprising:

a generally cylindrical main body having an upper section and a lower section;

a drill bit attached to an end of the lower section of the main body;

a reamer attached to the upper section of the main body;

a sub connected between the upper and lower sections which is capable of expanding and retracting which changes the length of the bottom-hole assembly, wherein the sub includes a spring which passes through a retaining plate which is moved laterally by a grub screw such that as the plate is turned by the grub screw the length of the spring can elastically deform below the plate by compressing a part of the spring above the retaining plate, which in turn alters the length of the main body;

a first measurement device attached to the main body above the reamer; and a second measurement device attached to the main body below the reamer.

2. The bottom-hole assembly according to claim 1, further comprising a motor which controls rotation of the grub screw and a hydraulic pump which supplies power to the motor via mud circulation.

3. The bottom-hole assembly according to claim 1, wherein the first and second measurement devices are capable of obtaining data, which includes one or more of a tension, compression, flexural bending and torque measurement of the main body during operation of the bottom-hole assembly.

4. The bottom-hole assembly according to claim 3, further comprising a device for communicating to a data processing device which is capable of processing said data to determine whether the bottom-hole assembly should be shortened or lengthened to alleviate down-hole spiraling of a drill string comprising the bottom-hole assembly, said data processing device further capable of sending operational commands to the sub in order to activate the sub to alter its length to prevent said condition from occurring.

5. The bottom-hole assembly according to claim 4, wherein the data processing device is located on the sub or at the surface.

6. The bottom-hole assembly according to claim 4, wherein the communicating device comprises a device selected from the group consisting of wires, a down-hole telemetry system, a down-hole acoustic system, fiber optic communication and combinations thereof.

7. The bottom-hole assembly according to claim 1, wherein the first and second measurement devices are selected from the group consisting of transducers, strain gauges, gyroscopes, magnetometers, and combinations thereof mounted in such a way as to measure axial strain, tension, torque, bending moment, rotational speed and/or changes in velocity.

8. The bottom-hole assembly according to claim 1, wherein the sub further comprises:

a first body;

a second body having a chamber formed therein, wherein the first body is partially located in the chamber of the second body, wherein the spring, the retaining plate, and the grub screw are all located in the chamber, and wherein the spring extends between the retaining plate and an end of the first body; and a motor which controls rotation of the grub screw, wherein the motor is partially disposed within the second body and extends partially into the chamber.

9. The bottom-hole assembly according to claim 8, wherein the first body of the sub comprises:

a flowbore extending at least partially therethrough; and an end plate at the end of the first body, wherein the spring contacts the end plate, and wherein the end plate comprises narrowed ports extending therethrough to communicate fluid from the flowbore of the first body into the chamber.

10. The bottom-hole assembly according to claim 8, wherein the second body is attached at a lower end to a lower sub portion of the sub, wherein the lower sub portion comprises a vertical flowbore extending therethrough, and wherein the second body comprises two narrowed flow passages extending from the chamber to the vertical flowbore of the lower sub portion to provide fluid communication between the chamber and the vertical flowbore of the lower sub portion.

11. The bottom-hole assembly according to claim 10, wherein the narrowed flow passages are located on opposite sides of the motor within the second body and are oriented at an acute angle relative to an axis of the sub.

12. A method of alleviating down-hole spiraling of a drill string having a bottom-hole assembly defined by a main body having a reamer and drill bit during a drilling operation, comprising:

gathering data which includes one or more of a tension, compression, flexural bending and torque measurement of the main body;

determining a depths-of-cut rate by the drill bit and the reamer based on the data;

extending or shortening a longitudinal length of the main body of the bottom-hole assembly under the condition where the depth-of-cut rate by the drill bit is not substantially the same as the depth-of-cut rate of the reamer;

wherein the longitudinal length of a main body is extended or shortened using a sub disposed in the main body between the drill bit and the reamer and wherein the sub includes a spring which passes through a retaining plate which is moved laterally by a grub screw such that as the plate is turned by the grub screw the length of the spring can elastically deform below the plate by compressing a part of the spring above the retaining plate, which in turn alters the length of the main body.

13. The method according to claim 12, further comprising gathering the data from locations above and below the reamer.

14. The method according to claim 13, wherein gathering data includes measuring one or more tension, compression, flexural bending and torque of the main body above and below the reamer using one or more transducers, strain gauges, gyroscopes, magnetometers, and combinations thereof mounted in such a way as to measure axial strain, tension, torque, bending moment, rotational speed and/or changes in velocity.

15. The method according to claim 12, wherein gathering data comprises using a device which communicates to a data processing device which is capable of processing said data to determine whether down-hole spiraling of a drill string is occurring based on said data, said data processing device further capable of sending operational commands to the sub in order to activate the sub to alter its length to prevent said condition from occurring.

16. The method according to claim 15, wherein the data processing device is located on the sub or at the surface.

17. The method according to claim 15, wherein the communicating device is selected from the group consisting of a wired connection, down-hole telemetry, acoustics, fiber optics and combinations thereof.

18. The method according to claim 12, wherein the sub further comprises:

a first body;

a second body having a chamber formed therein, wherein the first body is partially located in the chamber of the second body, wherein the spring, the retaining plate, and the grub screw are all located in the chamber, and wherein the spring extends between the retaining plate and an end of the first body; and a motor which controls rotation of the grub screw, wherein the motor is partially disposed within the second body and extends partially into the chamber.

19. The method according to claim 18, further comprising communicating fluid between a flowbore extending at least partially through the first body of the sub and the chamber via narrowed ports extending through an end plate at the end of the first body, wherein the spring contacts the end plate.

20. The method according to claim 18, further comprising communicating fluid between the chamber and a vertical flowbore extending through a lower sub portion of the sub via two narrowed flow passages extending through the second body, wherein the second body is attached at a lower end to the lower sub portion, and wherein the narrowed flow passages are located on opposite sides of the motor within the second body and are oriented at an acute angle relative to an axis of the sub.

* * * * *